US007567185B2

(12) United States Patent
Zhang

(10) Patent No.: US 7,567,185 B2
(45) Date of Patent: Jul. 28, 2009

(54) CIRCUIT FOR POWER INDICATOR

(75) Inventor: Xiang Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 163 days.

(21) Appl. No.: 11/695,065

(22) Filed: Apr. 2, 2007

(65) Prior Publication Data

US 2008/0143541 A1 Jun. 19, 2008

(30) Foreign Application Priority Data

Dec. 15, 2006 (CN) ..... 2006 2 0016488 U

(51) Int. Cl.
*G08B 5/22* (2006.01)

(52) U.S. Cl. ..... 340/815.45; 340/635; 340/691.1

(58) Field of Classification Search ..... 315/129–136, 315/209 R, 291; 340/815.4, 815.45, 691.1, 340/691.6, 635
See application file for complete search history.

(56) References Cited

U.S. PATENT DOCUMENTS 7,019,658 B1 * 3/2006 Erickson et al. ..... 340/635
2006/0138967 A1 * 6/2006 Zhou et al. ..... 315/129
2007/0075872 A1 * 4/2007 Zhang ..... 340/815.4
2007/0096936 A1 * 5/2007 You et al. ..... 340/815.45
2008/0111500 A1 * 5/2008 Hoover ..... 315/293
2008/0126818 A1 * 5/2008 Sawyers et al. ..... 713/330

* cited by examiner

*Primary Examiner*—David Hung Vu
*Assistant Examiner*—Tung X Le
(74) *Attorney, Agent, or Firm*—Frank R. Niranjan

(57) ABSTRACT

A circuit for a power indicator, comprises an indicator (10), a power source ($V_1$), a first MOSFET (20), a first controlling circuit (40), a second MOSFET (50), and a second controlling circuit (60). The indicator includes a positive terminal and a negative terminal. The power source is connected to the positive terminal of the indicator via a resistor (30). A drain of the first MOSFET is connected to the negative terminal of the indicator. The first controlling circuit transmits a controlling signal to a gate of the first MOSFET according to working statuses of a computer. A drain of the second MOSFET is connected to a source of the first MOSFET and a source of the second MOSFET is connected to ground. The second controlling circuit transmits a controlling signal to a gate of the second MOSFET.

16 Claims, 2 Drawing Sheets

FIG. 1 <PRIORART>

CIRCUIT FOR POWER INDICATOR

BACKGROUND OF THE INVENTION

1. Field of the Invention

The present invention relates to circuits for power indicators, and more particularly to a circuit for a power indicator in a computer.

2. Description of Related Art

A computer system is composed of hardware and software. The hardware typically includes a motherboard, an optical disk drive, a hard disk drive, a memory, a network card, and so on. When the computer system is running, it is necessary to know working statuses of the hardware. So, indicator lights are used to show the working statues of the hardware, and corresponding drive circuits for driving these indicator lights are combined in the computer system.

Referring to FIG. 1, a typical circuit for a power indicator includes a light emitting diode 10', a P-channel MOSFET (metal oxide semiconductor field effect transistor) 20', a resistor 30', and a controlling circuit 40'. A positive terminal of the light emitting diode 10' is connected to a power source $V_0$ via the resistor 30' and a negative terminal of the light emitting diode 10' is connected to a drain of the P-channel MOSFET 20'. The controlling circuit 40' is connected to a gate of the P-channel MOSFET 20'. A source of the P-channel MOSFET 20' is connected to a ground. According to working statuses of a computer, the controlling circuit 40' sends a controlling signal $S_0$ to the gate of the P-channel MOSFET 20'. For example, when the hardware is writing data, the controlling circuit 40' sends a controlling signal $S_0$ with high level to turn on the MOSFET 20' so that the light emitting diode 10' is turned on to thereby show the working statuses of writing data of the hardware.

When the computer is on and working normally, the level of the controlling signal $S_0$ is set by the controlling circuit 40' according to working statuses of the computer. The light emitting diode 10' can correctly show the working statuses of the computer. However, when the computer is down and needs to be restarted or rebooted, the controlling circuit 40' may send no controlling signal to enable the P-channel MOSFET 20' to be turned off, and the light emitting diode 10' may remain lit giving a false indication.

SUMMARY OF THE INVENTION

A circuit for a power indicator comprises, an indicator, a power source, a first MOSFET, a first controlling circuit, a second MOSFET, and a second controlling circuit. The indicator includes a positive terminal and a negative terminal. The power source is connected to the positive terminal of the indicator via a resistor. A drain of the first MOSFET is connected to the negative terminal of the indicator. The first controlling circuit transmits a controlling signal to a gate of the first MOSFET according to working statuses of a computer. A drain of the second MOSFET is connected to a source of the first MOSFET and a source of the second MOSFET is connected to ground. The second controlling circuit transmits a controlling signal to a gate of the second MOSFET.

Other advantages and novel features of the present invention will become more apparent from the following detailed description of preferred embodiment when taken in conjunction with the accompanying drawings, in which:

DETAILED DESCRIPTION OF THE INVENTION

Figure 1:
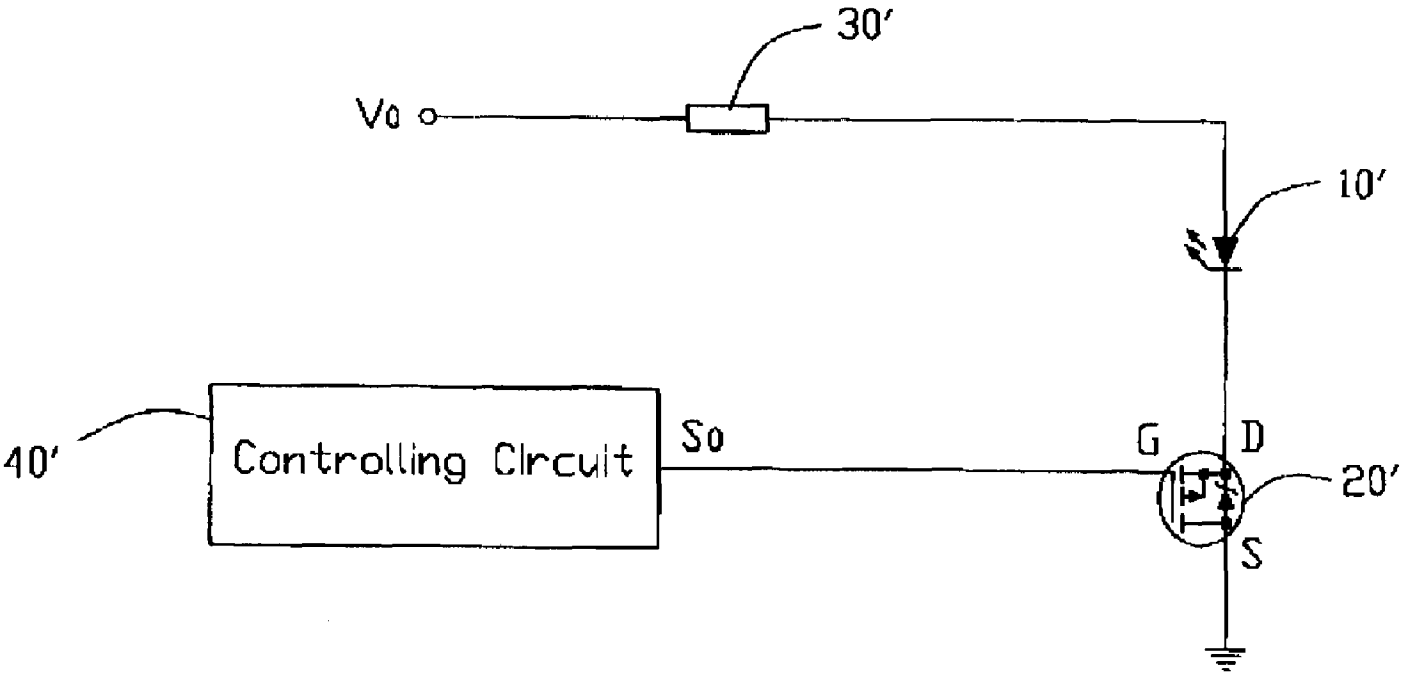
FIG. 1 is a diagram of a prior art circuit for a power indicator.
Figure 2:
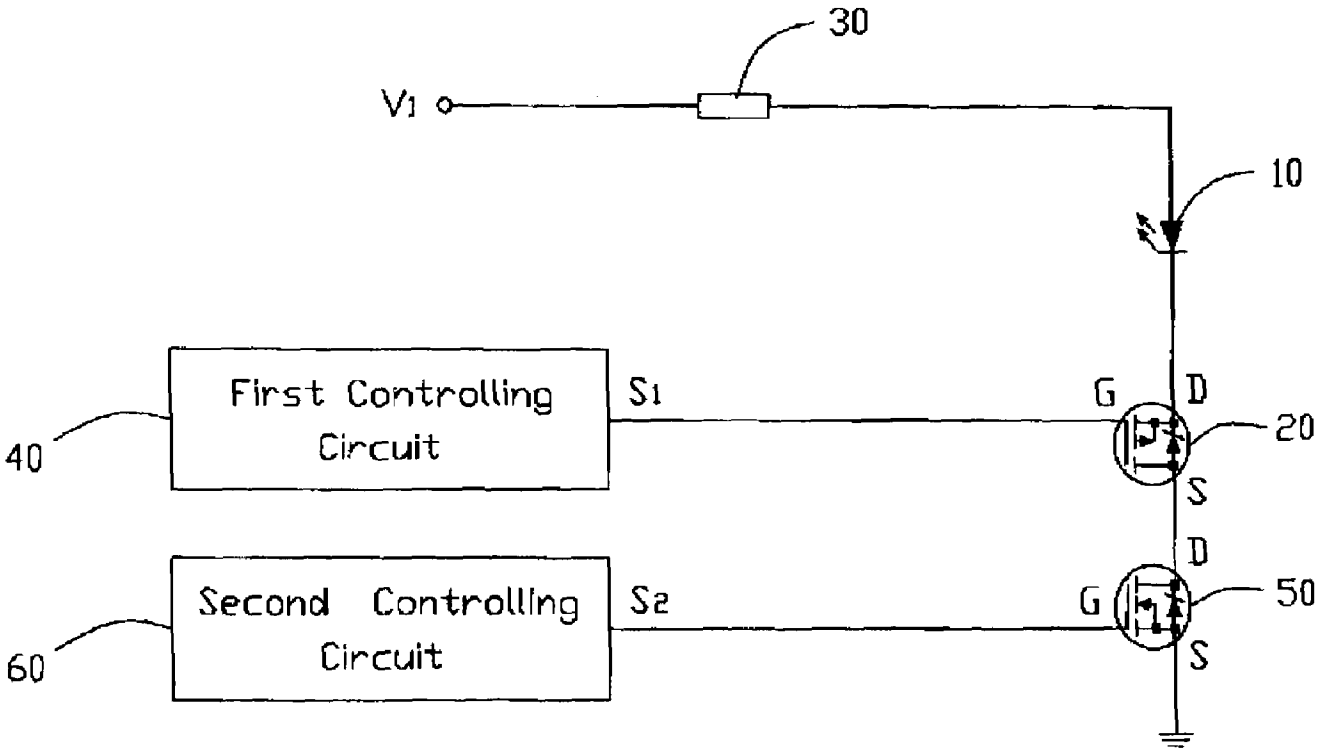
FIG. 2 is a diagram of a circuit for a power indicator in accordance with a preferred embodiment of the present invention.

Referring to FIG. 2, a circuit for a power indicator in accordance with a preferred embodiment of the present invention includes a power source $V_1$, a light emitting diode 10, a P-channel MOSFET 20, a resistor 30, a first controlling circuit 40, an N-channel MOSFET 50, and a second controlling circuit 60. A positive terminal of the light emitting diode 10 is connected to the power source $V_1$ via the resistor 30. A negative terminal of the light emitting diode 10 is connected to a drain of the P-channel MOSFET 20. The first controlling circuit 40 is connected to a gate of the P-channel MOSFET 20. A source of the P-channel MOSFET 20 is connected to a drain of the N-channel MOSFET 50. A gate of the N-channel MOSFET 50 is connected to the second controlling circuit 60. A source of the N-channel MOSFET 50 is connected to ground.

Generally, the first controlling circuit 40 transmits a controlling signal $S_1$ to the gate of the P-channel MOSFET 20 according to working statuses of the computer. When the computer is powered on or off, the second controlling circuit 60 transmits a high or low level controlling signal $S_2$ to the gate of the N-channel MOSFET 50 respectively. In this embodiment, the second controlling circuit 60 is a power controlling circuit of the computer, when the computer is on, the power controlling circuit provides a high level signal to turn on the N-channel MOSFET 50; when the computer is powered off, the power controlling circuit provides a low level signal to turn off the N-channel MOSFET 50.

When the computer is on and operating normally, the controlling signal $S_2$ is high, which enables the N-channel MOSFET 50 to be turned on. The first controlling circuit 40 sends the controlling signal $S_1$ to turn on or off the P-channel MOSFET 20 according to working statuses of the computer, so the light emitting diode 10 can correctly show the working statuses of the computer. When the computer is off, the controlling signal $S_2$ is low, which enables the N-channel MOSFET 50 to be turned off, whether the controlling signal $S_1$ is high or low, the light emitting diode 10 can not light to give a false indication.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit for a power indicator, comprising:

an indicator comprising a positive terminal and a negative terminal;

a power source connected to the positive terminal of the indicator via a resistor;

a first MOSFET comprising a drain connected to the negative terminal of the indicator;

a first controlling circuit for transmitting a controlling signal responsive to working statuses of a computer to a gate of the first MOSFET;

a second MOSFET comprising a drain connected to a source of the first MOSFET, and a source connected to ground; and a second controlling circuit for transmitting a controlling signal to a gate of the second MOSFET;

wherein when the computer is powered on or off, the second controlling circuit transmits the controlling signal to turn on or off the second MOSFET respectively.

2. The circuit as described in claim 1, wherein the second MOSFET is an N-channel MOSFET.

3. The circuit as described in claim 2, wherein the second controlling circuit is a power controlling circuit, when the computer is powered on or off, the power controlling circuit transmits a high or low level controlling signal to the gate of the N-channel MOSFET to thereby turn on or off the second MOSFET respectively.

4. The circuit as described in claim 1, wherein the indicator is a light emitting diode.

5. The circuit as described in claim 1, wherein the first MOSFET is a P-channel MOSFET.

6. A circuit for a power indicator in a computer, comprising:

an indicator comprising a positive terminal and a negative terminal;

a power source connected to the positive terminal of the indicator via a resistor;

a first MOSFET comprising a drain connected to the negative terminal of the indicator and a gate for receiving a first controlling signal responsive to working statuses of the computer; and a second MOSFET comprising a drain connected to a source of the first MOSFET, a source connected to ground and a gate for receiving a second controlling signal;

wherein when the computer is powered on or off, the second MOSFET receives the second controlling signal to be turned on or off respectively.

7. The circuit as described in claim 6, wherein the second MOSFET is an N-channel MOSFET.

8. The circuit as described in claim 6, wherein the first MOSFET is a P-channel MOSFET.

9. The circuit as described in claim 6, wherein the indicator is a light emitting diode.

10. A circuit for a power indicator in a computer, comprising:

an indicator comprising a first terminal electrically connected to a power source and a second terminal;

a first electric switch and a second electric switch connecting the second terminal of the indicator to ground in series;

a first controlling circuit for transmitting a first controlling signal responsive to working statuses of the computer to the first electric switch; and a second controlling circuit for transmitting a second controlling signal responsive to on or off of the computer to the second electric switch; wherein when the computer is powered on, the second electric switch is turned on and the first electric switch is selectively turned on or off according to the working statuses of the computer to thereby allow the indicator showing the corresponding working statuses of the computer, and when the computer is powered off, the second electric switch is turned off which results in the indicator being turn off.

11. The circuit as described in claim 10, wherein the first electronic switch and the second electronic switch are field effect transistors (FETs).

12. The circuit as described in claim 11, wherein the first FET has a drain connected to the second terminal of the indicator, a gate connected to the first controlling circuit and a source connected to a drain of the second FET.

13. The circuit as described in claim 12, wherein the second FET has a gate connected to the second controlling circuit and a source connected to ground.

14. The circuit as described in claim 13, wherein the second FET is an N-channel metal oxide semiconductor FET.

15. The circuit as described in claim 12, wherein the first FET is a P-channel metal oxide semiconductor FET.

16. The circuit as described in claim 10, wherein the indicator is a light emitting diode.

* * * * *